US005388511A

United States Patent [19]

Iijima

[11] Patent Number: 5,388,511

[45] Date of Patent: Feb. 14, 1995

[54] ROTARY PRESS

[75] Inventor: Takashi Iijima, Yokosuka, Japan

[73] Assignee: Kabushikigaisha Tokyo Kikai Seisakusho, Tokyo, Japan

[21] Appl. No.: 945,582

[22] Filed: Sep. 16, 1992

Related U.S. Application Data

[63] Continuation of Ser. No. 658,446, Feb. 21, 1991, abandoned, which is a continuation of Ser. No. 333,240, Apr. 5, 1989, abandoned.

[30] Foreign Application Priority Data

May 24, 1988 [JP] Japan ..... 63-126858

[51] Int. Cl.[6] ..... B41F 31/06

[52] U.S. Cl. ..... 101/148; 101/483

[58] Field of Search ..... 101/148, 147, 349, 350, 101/351, 352, 365, 207-210, 181, 220, 483

[56] References Cited

U.S. PATENT DOCUMENTS

| | | | |
|---|---|---|---|
| 4,428,291 | 1/1984 | Dorow | 101/350 |
| 4,690,055 | 9/1987 | Fadner et al. | 101/148 X |
| 4,796,549 | 1/1989 | Okamura | 101/350 |

FOREIGN PATENT DOCUMENTS

| | | | |
|---|---|---|---|
| 58-3868 | 1/1983 | Japan | 101/350 |
| 163857 | 7/1986 | Japan | 101/148 |
| 192556 | 8/1986 | Japan | 101/349 |

*Primary Examiner*—J. Reed Fisher

*Attorney, Agent, or Firm*—Foley & Lardner

[57] ABSTRACT

A rotary press includes a plurality of cylinders including plate cylinders arranged to perform printing. Each of the plate cylinders is supplied with ink through an inking unit which is associated with the plate cylinder. The inking unit is composed of at least one of form rollers, an ink metering roller which is in contact with an ink metering doctor blade, and a fountain roller partially dipped in an ink fountain pan. At least one of the inking units further includes an intermediate roller interposed between the upperstream side of the form roller(s) and the downstream side of the metering roller when the ink fountain pan is located above the plate cylinder to be supplies with ink through the inking unit. The intermediate roller can freely change the revolving direction of the metering roller so that the ink metering doctor blade can be arranged at any proper position where is no obstruction to adjust the contact angle of the doctor blade onto the mesh roller and repair or replace the doctor blade per se.

5 Claims, 3 Drawing Sheets

ROTARY PRESS

This application is a continuation of application Ser. No. 07/658,466, filed Feb. 21, 1991, now abandoned, which is a continuation of Ser. No. 07/333,240, filed Apr. 5, 1989, now abandoned.

BACKGROUND OF THE INVENTION

1. Field of the Invention

The present invention relates to a printing apparatus equipped with an inking unit for supplying ink to a printing plate mounted on a plate cylinder through an inking cylinder or roller. More particularly, the present invention relates to one type of printing apparatus such as a satellite type rotary press whose inking unit is arranged above the plate cylindar.

2. Description of the Prior Art

A conventional satellite type rotary press such as a satellite type offset rotary press has been broadly known as disclosed in "News Paper Print, Printing Edition Reversed Version" published by Japan News Paper Association (Corporation) on Oct. 31, 1980, pp. 276, right column, lines 14 to 17. Such a rotary press comprises one common impression cylinder, and four sets of plate cylinders and blanket cylinders arranged around the impression cylinder to perform a four-colors printing on a single side of paper. In such a rotary press, a paper web travels through the four plates according to feeding work of the impression cylinder without a long pass for the paper web among the plate cylinders. Thus, such a rotary press provides an advantage in estimate accuracy owing to the paper web being stable on the impression cylinder. On the other hand, each of the plate cylinders is equipped with an inking unit including a plularity of rollers as shown in Japanese Patent Laid-Open Publication No. 63-28650 entitled "Printing Apparatus", in FIG. 5 on page 5.

Another type of satellite offset rotary press has been recently provided as shown in "Print Magazine the March issue" published by Print Society Inc., Printing Department, on Mar. 15, 1988, page 67 line 26 in center column to line 25 in right column including drawings. This type can reduce the number of rollers by using an ink metering cylinder (mesh roller).

One typical apparatus is shown in FIG. 2 wherein four inking units I1, I2, I3 and I4 are respectively associated with plate cylinders P1, P2, P3 and P4. The inking units I1, I2, I3 and I4 are essentially the same in construction, so that only one unit I1 will be explained. The inking unit I1 includes a fountain roller 2 which is partially dipped in ink stored in a fountain pan 1'(1). At the downstream side of the fountain roller 2, a mesh roller 3, functioning as an ink metering roller, is set so as to be in contact with the foutain roller 2. The mesh roller 3 is also in contact with a first doctor blade 6 for metering the ink on the circumferential surface of the mesh roller 3. Further, the downstream side of the mesh roller 3 is in contact with a pair of form rollers 4 and 5 which are in contact with a printing plate set on the circumferential surface of the plate cylinder P1. The mesh roller 3 is furthermore in contact with an elastic surface roller 7 at the downstream side of the form rollers 4 and 5 in the revolving direction of the mesh roller 3. The elastic surface roller 7 is in contact with a hard surface roller 8 whose circumferential surface is also in contact with a second doctor blade 9 for removing an excess ink. The elastic surface roller 7, the hard surface roller 8 and the second doctor blade 9 constitute an excess ink removing means 10.

As shown in FIG. 2, this apparatus further comprises a plurality of ink pans 11, 12 and 13 for receiving the ink scraped by the doctor blades 6 and 9 and/or the ink dropped from the fountain pan 1 and 1'. The inking units I1, I2, I3 and I4 and the plate cylinders P1, P2, P3 and P4 are respectively revolved in respective directions shown in FIG. 2 in accordance with revolving direction of a common impression cylinder IC around which a paper web WP is travelling. Further in FIG. 2, the reference numerals B1, B2, B3 and B4 denote blanket cylinders correspondingly arranged in contact with the plate cylinders P1, P2, P3 and P4, respectively. The reference numerals D1, D2, D3 and D4 denote dampening means arranged in the respective plate cylinders, and the reference GR denotes a guide roller for guiding the paper web.

However, the above described satellite type offset rotary press has also provided some demerits owing to the roller arrangement of the inking unit. Every inking unit employing the ink metering roller (mesh roller) 3 has the same arrangement of rollers, so that the first doctor blades 6 of the first plate cylinder P1 and the fourth plate cylinder P4 should be set in remarkably narrow space defined between the fountain pan 1' and the ink pan 12. This narrow space has caused difficulty or limitations for the operation and/or maintenance of the doctor blade 6. The doctor blade 6 should be adjusted to suitably fit its contact angle with the mesh roller 3 by manually adjustment, and thus this apparatus has required an experienced operator and relatively complicated operations and long periods for its adjustment and/or repairment. This demerit will reduce working efficiency of whole printing process.

BRIEF SUMMARY OF THE INVENTION

It is therefore an object of the present invention to provide an improved rotary press employing inking units which are capable of being easily adjusted and repaired.

Another object of the present invention is to provide an improved rotary press employing inking units whose metering doctor blades are easily adjusted to fit a suitable contact angle with respect to respective metering rollers.

To accomplish these objects, the rotary press according to the present invention comprises a plurality of plate cylinders; and a plurality of inking units which are respectively associated with the plate cylinders; each of the inking units being composed of at least one of form roller, an ink metering roller, and a fountain roller which are arranged in contact each other and whose roller series is arranged in upward direction or downward direction with respect to the plate cylinder. At least one of the inking units whose roller series is upwardly arranged includes further an intermediate roller between the ink metering roller and the form roller(s).

Other objects and advantages of the present invention will become apparent during the following discussion of the accompanying drawings.

DETAILED DESCRIPTION OF THE PREFERRED EMBODIMENT

The present invention will be discussed in conjunction with the drawings. Through the drawings the same numerals denote the same parts or corresponding elements, so that the same explanation will not be repeated.

Figure 1:
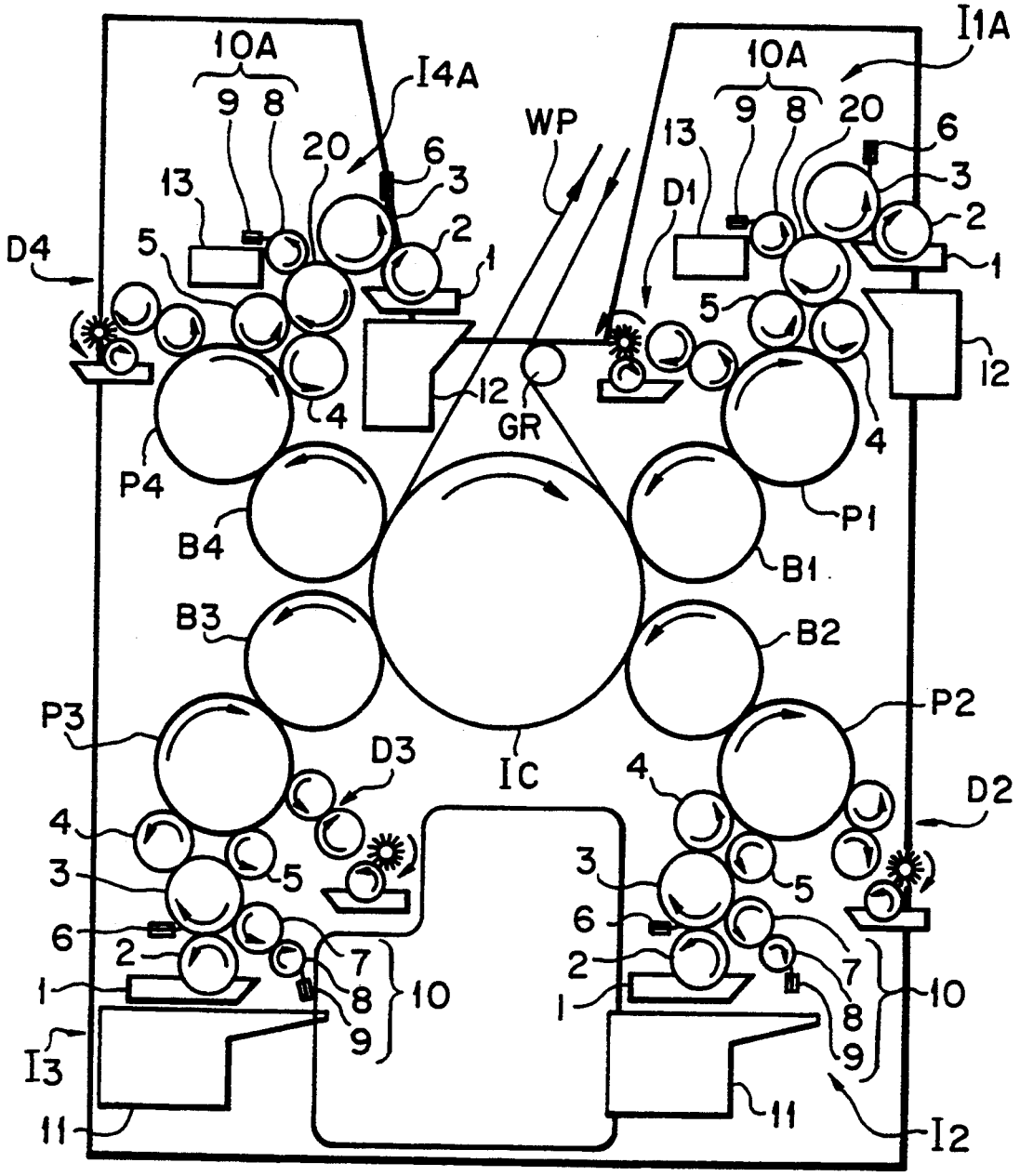
FIG. 1 is a schematic illustration showing the arrangement of plate cylinders and various rollers adapted for a satellite type offset rotary press according to preferred embodiment of the present invention.

FIG. 1 shows one preferred embodiment of a satellite type offset rotary press according to the present invention wherein four sets of plate cylinders P1, P2, P3 and P4 and blanket cylinders B1, B2, B3 and B4 are arranged around the circumference of a common impression cylinder IC. The plate cylinders P1, P2, P3 and P4 are respectively associated with inking units I1A, I2, I3 and I4A, and dampening units D1, D2, D3 and D4. This constitution is substantially similar as that of the conventional device as described above except for the inking units I1A and I4A.

The inking units I1A and I4A have essentially the same configuration, wherein the reference numeral 1 denotes an ink fountain pan. A fountain roller 2 is partially dipped in the ink reserved in the ink fountain pan 1. At the downstream side of the fountain roller 2, a mesh roller 3 as an ink metering roller is set so as to be in contact with the fountain roller 2. The mesh roller 3 is also in contact with a first doctor blade 6 for metering the ink on the circumferential surface of the metering roller 3. Further, the downstream side of the mesh roller 3 is in contact with an intermediate roller 20 whose downstream side is in contact with a pair of form rollers 4 and 5 which are in contact with a printing plate set on the circumferential surface of the plate cylinder P1(P4). At the downstream position of the form rollers 4 and 5, the intermediate roller 20 is furthermore in contact with a hard surface roller 8 whose circumferential surface is also in contact with a second doctor blade 9 for removing an excess ink. The hard surface roller 8 and the second doctor blade 9 constitute an excess fluid removing means 10A. This apparatus further comprises a plurality of ink pans 11, 12 and 13 for receiving the ink scraped by the doctor blades 6 and 9 and/or the ink dropped from the fountain pan 1 and 1'.

Figure 2:
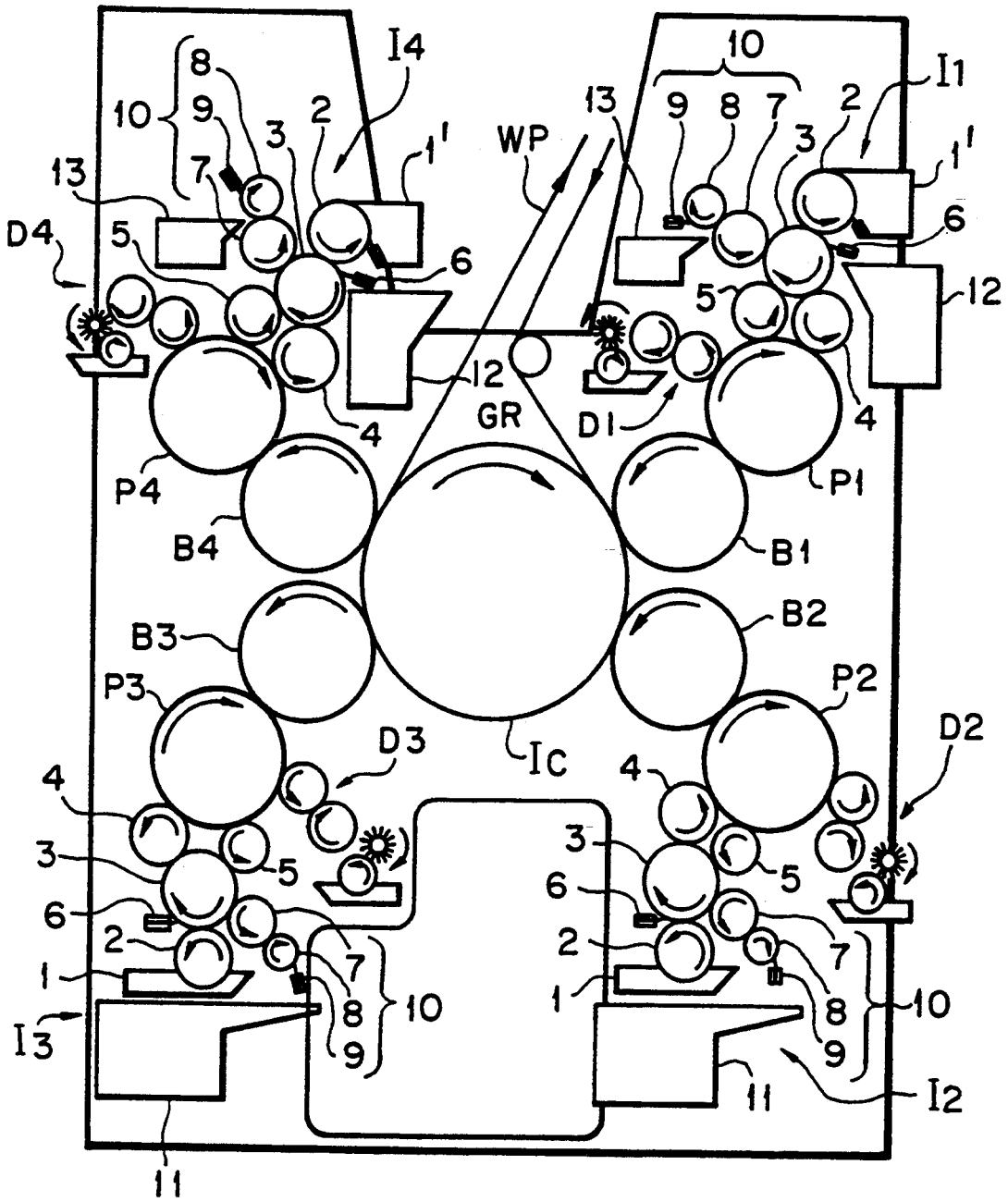
FIG. 2 is a schematic illustration showing the arrangement of plate cylinders and various rollers adapted for a conventional satellite type offset rotary press.

This apparatus also includes inking units I2 and I3, and dampening units D1, D2, D3 and D4 configured in the same manner as FIG. 2.

In the thus constituted rotary press, a paper web WP travels around essentially ¾ of the circumferential surface of the common impression cylinder IC through a guide roller GR and fed to another guide roller, not shown, in the direction represented by the arrow. In accordance with the revolution of the common impression cylinder IC, the blanket cylinders B1, B2, B3 and B4; the plate cylinders P1, P2, P3 and P4; the rollers and cylinders of the inking units I1A, I2, I3 and I4A; and the dampening units D1, D2, D3 and D4 are respectively revolved in the predetermined directions as shown in FIG. 1.

In the inking unit I1A (I4A), the metering roller 3 and the fountain roller 2 are revolved in the reverse direction of the conventional inking units I1 and I4 shown in FIG. 2 owing to the intermediate roller 20 interposed between the downstream side of the metering roller 3 and the upperstream side of the form rollers 4 and 5. Thus, the first doctor blade 6 is brought in contact with the metering roller 3 at the upper downstream side thereof where there are no parts or components. The contact angle of the first doctor blade 6 can be easily adjusted visually and repaired without any obstructions. The ink scraped by the first doctor blade 6 is fed back to the ink fountain pan 1 through the fountain roller 2.

The excess fluid removing means 10A can remove the dampening fluid reaching the form rollers 4 and 5 through the printing plate on the plate cylinder P1 (P4), and the excess ink conveyed on the non-image area of the printing plate and remaining on the form rollers 4 and 5. Such excess dampening fluid and ink are gathered through the intermedite roller 20 and fed into the ink pan 13.

Figure 3:
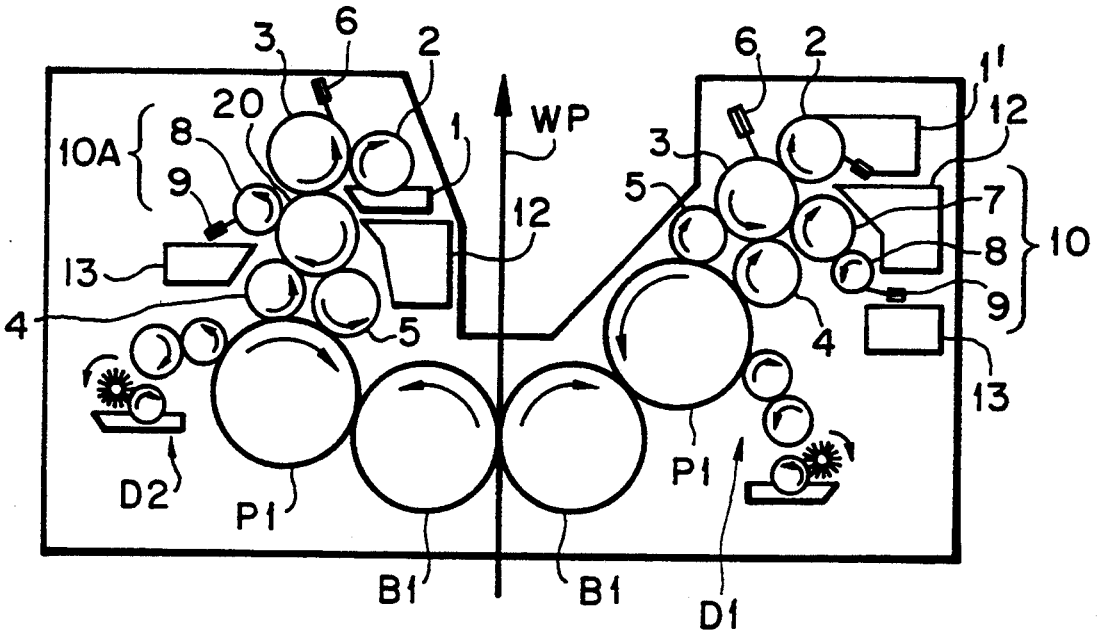
FIG. 3 is a schematic illustration showing the arrangement of plate cylinders and various rollers adapted for a B—B type offset rotary press according to the present invention.

FIG. 3 shows one example of a B—B type offset rotary press according to the present invention. In this drawing, the same reference numerals denote the same or corresponding parts of the above described satellite type rotary press. The B—B type offset rotary press comprises a right side roller series without an intermediate roller and a left side roller series with an intermediate roller 20. A paper web WP is conveyed between a pair of blanket cylinder B1 which are revolved in the reverse direction each other. The roller series are arranged in essentially the same manner as the above described embodiment, and therefore they are possessed of substantially the same function.

As explained above, the intermediate roller interposed between the mesh roller and the form rollers can freely change the revolving direction of the mesh roller so that the ink metering doctor blade can be arranged at any proper position where no obstruction prevents the adjustment of the contact angle of the doctor blade onto the mesh roller or prevents the repair or replacement of the doctor blade per se.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A rotary press comprising a plurality of plate cylinders, each of said plate cylinders cooperating with an inking unit adapted to supply ink thereto, each of said inking units comprising a form roller contacting the respective plate cylinder, an ink fountain pan located above the respective plate cylinder, a fountain roller at least partially dipped in said fountain pan, a mesh roller contacting said fountain roller and adapted to act as an ink metering roller, a doctor blade contacting a peripheral surface of said mesh roller, a dampening device contacting said plate cylinder, and an intermediate roller disposed between said form roller and said mesh roller.

2. The rotary press of claim 1, wherein each of said inking units further comprises another form roller contacting the respective plate cylinder.

3. The rotary press of claim 2, wherein said form rollers, said fountain roller, and said intermediate roller of at least one of said inking units are all positioned above the respective plate cylinder.

4. A method of supplying ink to a rotary press comprising a plurality of plate cylinders, said method comprising the steps of:

drawing ink out of a fountain pan by rotating a fountain roller which is at least partially dipped in said fountain pan;

withdrawing a metered amount of ink from said fountain roller via a meshed ink metering roller which contacts said fountain roller;

removing excess ink from said ink metering roller via a doctor blade which contacts a peripheral surface of said ink metering roller;

transferring ink from said ink metering roller to a form roller via an intermediate roller which contacts said ink metering roller and said form roller;

rotating said form roller to transfer ink from said form roller to one of said plate cylinders; and supplying dampening water to said one plate cylinder via a dampening device which contacts said one plate cylinder.

5. The process of claim 4, further comprising the step of adjusting the angle of contact between said doctor blade and said ink metering roller.

* * * * *